US008403721B2

(12) United States Patent
Derman

(10) Patent No.: US 8,403,721 B2
(45) Date of Patent: Mar. 26, 2013

(54) TOY SET AND RELAY SEGMENTS

(75) Inventor: Scott H. Derman, Redondo Beach, CA (US)

(73) Assignee: Mattel, Inc., El Segundo, CA (US)

( * ) Notice: Subject to any disclaimer, the term of this patent is extended or adjusted under 35 U.S.C. 154(b) by 203 days.

(21) Appl. No.: 12/766,799

(22) Filed: Apr. 23, 2010

(65) Prior Publication Data

US 2011/0263176 A1 Oct. 27, 2011

(51) Int. Cl.
*A63H 33/04* (2006.01)

(52) U.S. Cl. ..... 446/2; 446/102; 446/108; 446/116; 446/124

(58) Field of Classification Search ..... 446/2, 83, 446/102, 168–174, 444, 85, 166, 69, 116, 446/124; 273/110, 276, 399
See application file for complete search history.

(56) References Cited

U.S. PATENT DOCUMENTS 2,585,754 A * 2/1952 Dunkelberger ..... 238/10 E
3,283,439 A * 11/1966 Rosen ..... 446/2
3,283,440 A * 11/1966 Rosen ..... 446/2
3,946,516 A * 3/1976 Wirth ..... 446/117
4,219,198 A * 8/1980 Meyer et al. ..... 273/399
6,536,763 B1 * 3/2003 Braun ..... 273/118 R
7,600,757 B1 * 10/2009 Matilla et al. ..... 273/241
7,857,679 B2 * 12/2010 O'Connor et al. ..... 446/429
8,006,943 B2 * 8/2011 O'Connor ..... 246/415 A
2008/0057827 A1 * 3/2008 Brumagin et al. ..... 446/376

* cited by examiner

*Primary Examiner* — Gene Kim
*Assistant Examiner* — John E Simms, Jr.
(74) *Attorney, Agent, or Firm* — Cantor Colburn LLP

(57) ABSTRACT

A linking toy segment for pivotal securement to another linking toy segment is disclosed herein, the linking toy segment having: a base structure; an actuatable device secured to the base structure, the actuatable device being capable of movement from a first position to a second position; a first coupling member secured to the base structure and extending away from the base structure in a first direction, the first coupling member being configured to be pivotally received on top of another coupling member; a second coupling member secured to the base structure and extending away from the base structure in a second direction, the first direction being different from the second direction, the second coupling member being configured to be pivotally secured underneath another coupling member; a trigger moveably secured to the base structure proximate to either the first coupling member or the second coupling member, the trigger being pivotally mounted to the base for movement between a first position and a second position; and wherein the actuatable device is moved from the first position to the second position when the trigger is moved from the first position to the second position.

20 Claims, 7 Drawing Sheets

TOY SET AND RELAY SEGMENTS

BACKGROUND

Toy sets with relay segments have been popular for many years and generally include one or more track sections arranged to form a path around which one or more toy vehicles can travel. Toy vehicles which may be used on such track sets may be either self-powered vehicles or may receive power from an external source. In order to increase play value of the track sets, various track amusement features have been added to the track sets. For example, track features, such as stunt devices or elements, including loops, jumps, collision intersections, etc., have been included in such track sets to increase the play value of the track sets.

However, with many track sets, the vehicles run on a closed loop track moving through the same track features lap after lap. Although such track sets may have one or more stunt devices, a vehicle in the track set may perform the same stunt over and over as it travels along the track. Thus, even in track sets with more than one stunt device, the motion of the vehicle generally remains consistent for each vehicle as it travels along a specific section of the track. This repetitive nature of vehicle travel may result in loss of interest in the track set over a short period of time.

Some track sets have incorporated switching mechanisms to enable a user to direct a vehicle to a select travel path. However, generally such systems require manual manipulation of the track and/or manual actuation of a switch to reroute one or more vehicles traveling on the track. Play possibilities may be limited as travel along the select paths may again become repetitive over a short period of time.

Accordingly, it is desirable to provide a toy track set with interchangeable elements to provide numerous configurations.

SUMMARY OF THE INVENTION

In one embodiment, a linking toy segment for pivotal securement to another linking toy segment is provided, the linking toy segment having: a base structure; an actuatable device secured to the base structure, the actuatable device being capable of movement from a first position to a second position; a first coupling member secured to the base structure and extending away from the base structure in a first direction, the first coupling member being configured to be pivotally received on top of another coupling member; a second coupling member secured to the base structure and extending away from the base structure in a second direction, the first direction being different from the second direction, the second coupling member being configured to be pivotally secured underneath another coupling member; a trigger moveably secured to the base structure proximate to either the first coupling member or the second coupling member, the trigger being pivotally mounted to the base for movement between a first position and a second position; and wherein the actuatable device is moved from the first position to the second position when the trigger is moved from the first position to the second position.

In another exemplary embodiment, a toy set is provided the toy set having: a plurality of interchangeable linking segments each being configured for pivotal securement to each other, each linking segment having: a base structure; an actuatable device secured to the base structure, the actuatable device being capable of movement from a first position to a second position; a first coupling member secured to the base structure and extending away from the base structure in a first direction, the first coupling member being configured to be pivotally received on top of another coupling member; a second coupling member secured to the base structure and extending away from the base structure in a second direction, the first direction being different from the second direction, the second coupling member being configured to be pivotally secured underneath another coupling member of another one of the plurality of interchangeable linking segments; a trigger moveably secured to the base structure proximate to either the first coupling member or the second coupling member, the trigger being pivotally mounted to the base movement between a first position and a second position; and wherein the actuatable device is moved from the first position to the second position when the trigger is moved from the first position to the second position.

In still another exemplary embodiment, a method for pivotally coupling a plurality of toy relay segments together, the method including the steps of: securing either a first coupling member or a second coupling member of a first one of a plurality of interchangeable linking segments to either a first coupling member or a second coupling member of a second one of the plurality of interchangeable linking segments; wherein the first coupling member of the first one of the plurality of interchangeable linking segments is secured to a base structure and extends away from the base structure in a first direction and is configured to be pivotally received on top of the second coupling member of the second one of the plurality of interchangeable linking segments; wherein the second coupling member of the first one of the plurality of interchangeable linking segments is secured to the base structure and extends away from the base structure in a second direction and is configured to be pivotally received beneath the first coupling member of the second one of the plurality of interchangeable linking segments, the second direction being different from the first direction; and wherein an actuatable device is secured to each of the first one of the plurality of interchangeable linking segments and the second one of the plurality of interchangeable linking segments, each actuatable device being capable of movement from a first position to a second position and a trigger is moveably secured to each of the first one of the plurality of interchangeable linking segments and the second one of the plurality of interchangeable linking segments, each trigger being pivotally mounted for movement between a first position and a second position; and wherein the actuatable device of each of the plurality of interchangeable linking segments is moved from the first position to the second position when the trigger of the corresponding one of the plurality of interchangeable linking segments is moved from the first position to the second position.

DETAILED DESCRIPTION

In accordance with exemplary embodiments of the present invention a linking toy segment for pivotal securement to another linking toy segment is provided. In addition, a method for linking the toy segments together as well as a toy set comprising a plurality of linkable toy segments is provided.

Figure 1:
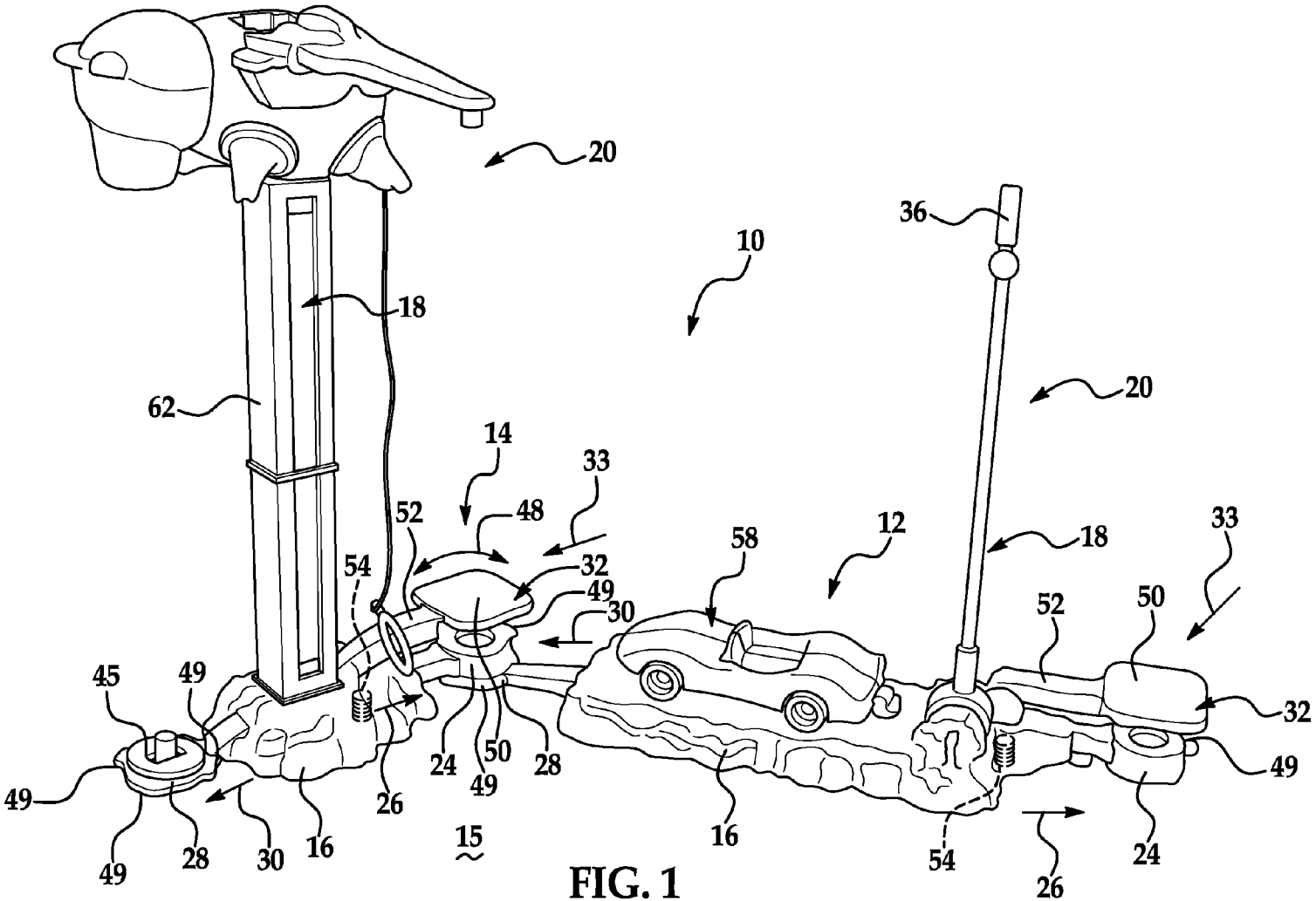
FIG. 1 is a perspective view of a toy set having interchangeable linking segments each being configured for pivotal securement to each other and each having an actuatable device in a first position.
Figure 2:
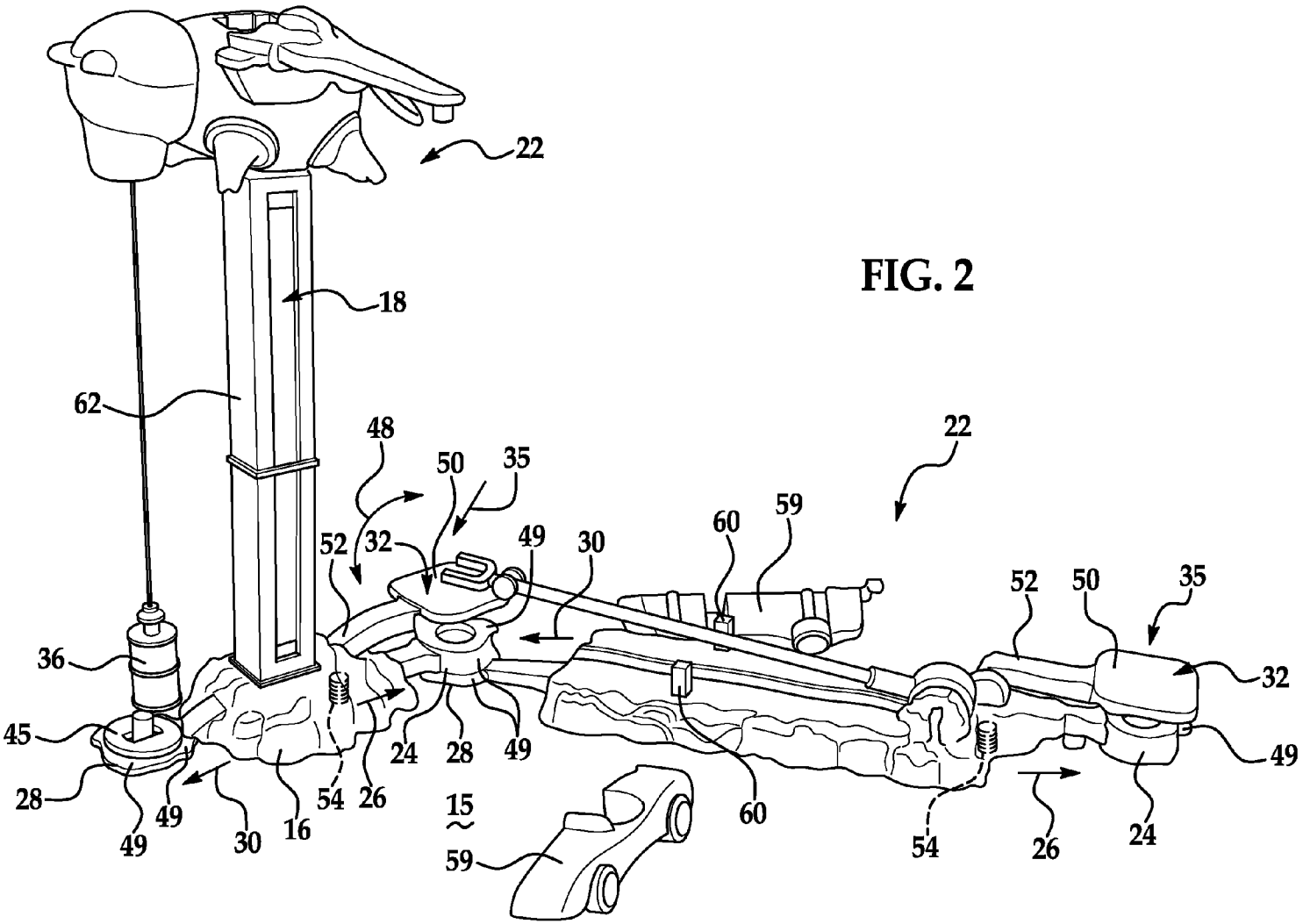
FIG. 2 is a perspective view of the toy set of FIG. 1 illustrating the actuatable devices in a second position.
Figure 3:
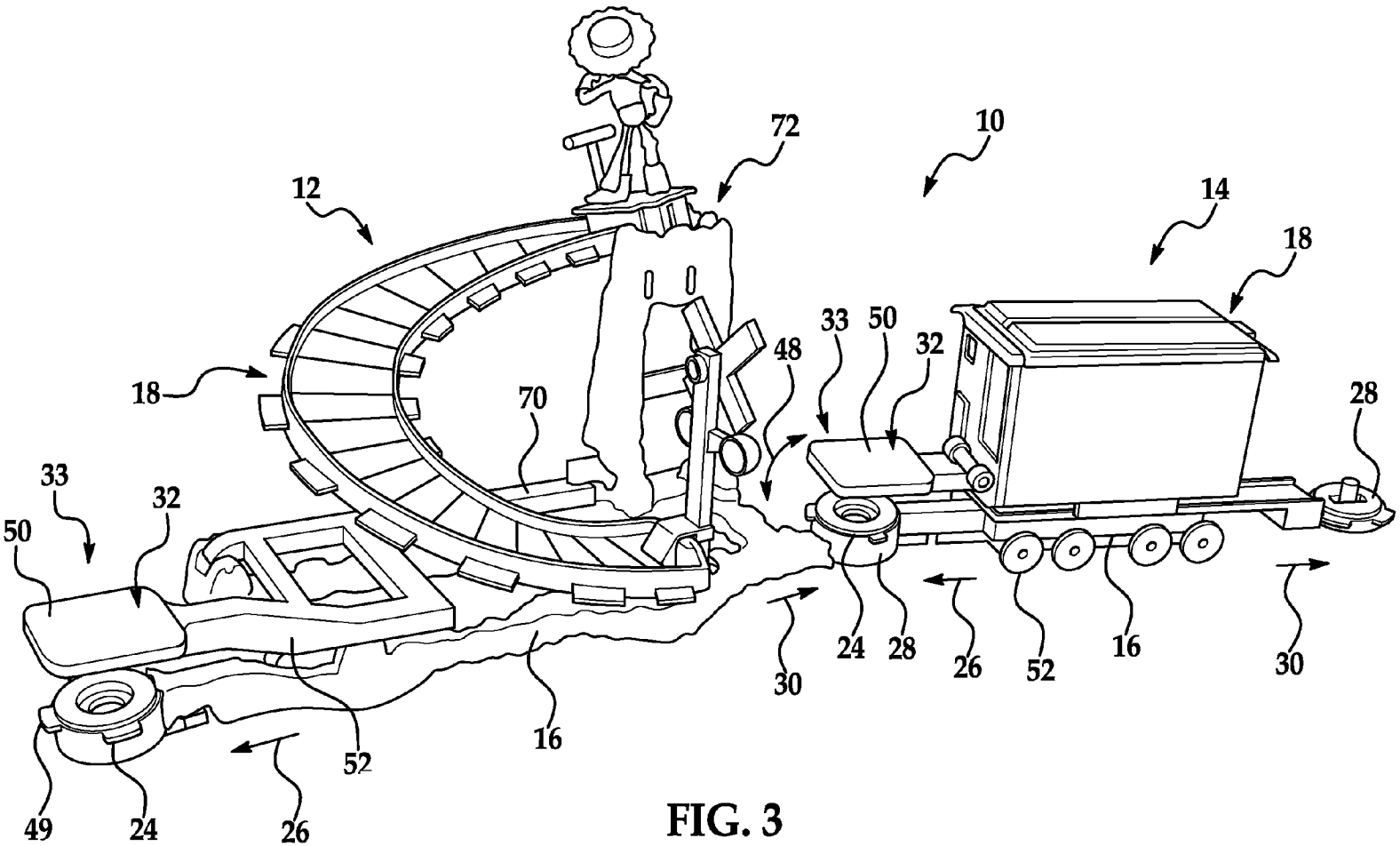
FIG. 3 is a perspective view of another toy set having interchangeable linking segments each being configured for pivotal securement to each other and each having an actuatable device in a first position.
Figure 4:
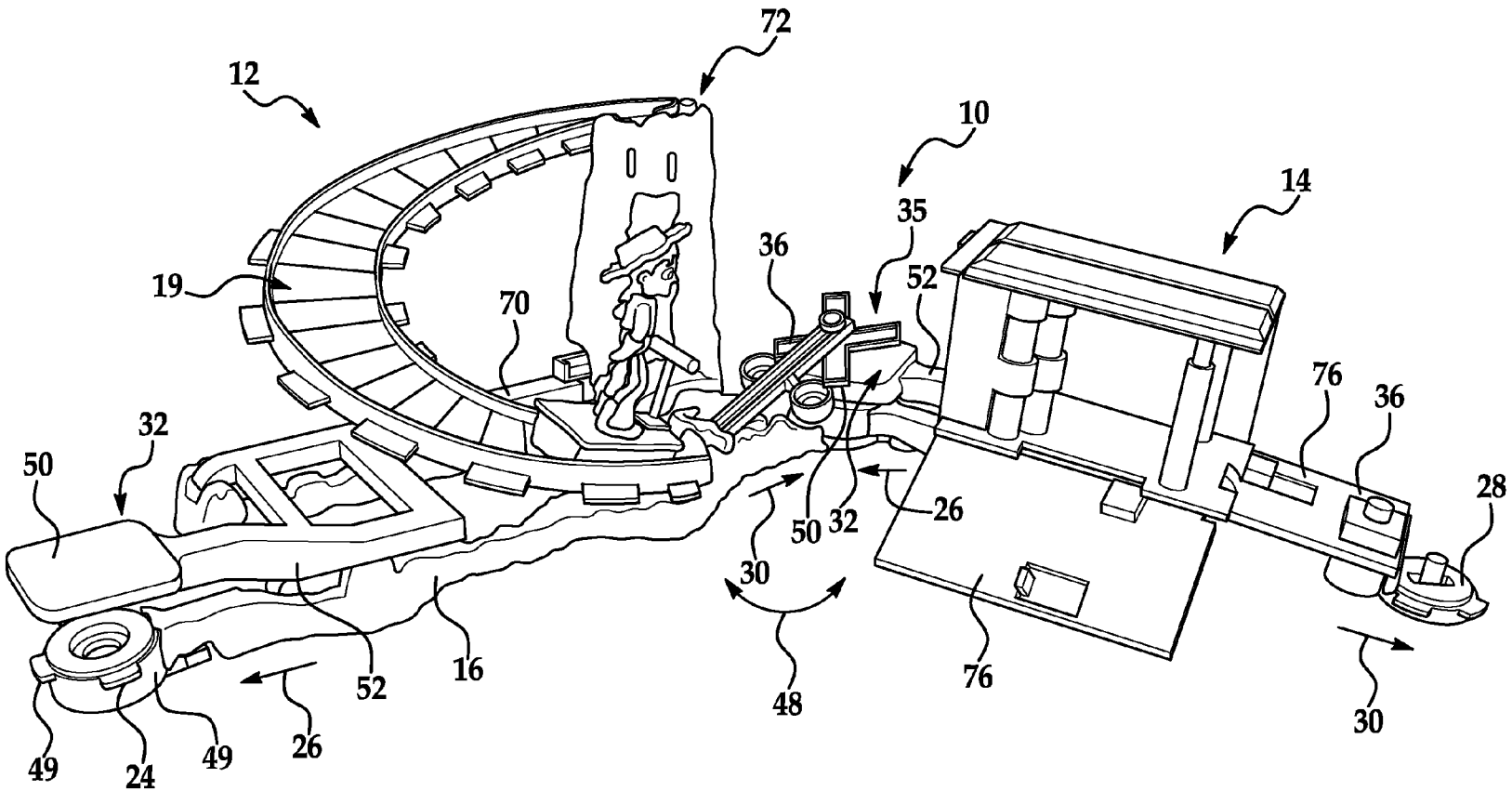
FIG. 4 is a perspective view of the toy set of FIG. 3 with the actuatable devices in a second position.
Figure 5:
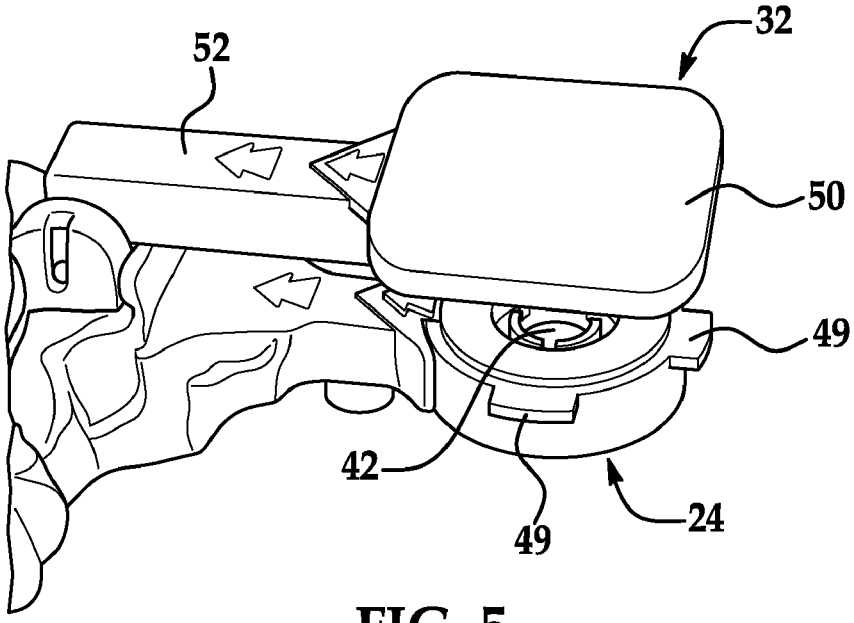
FIGS. 5 and 6 are enlarged perspective views of a first coupling member and a trigger of an interchangeable linking segment in accordance with an exemplary embodiment of the present invention.
Figure 6:
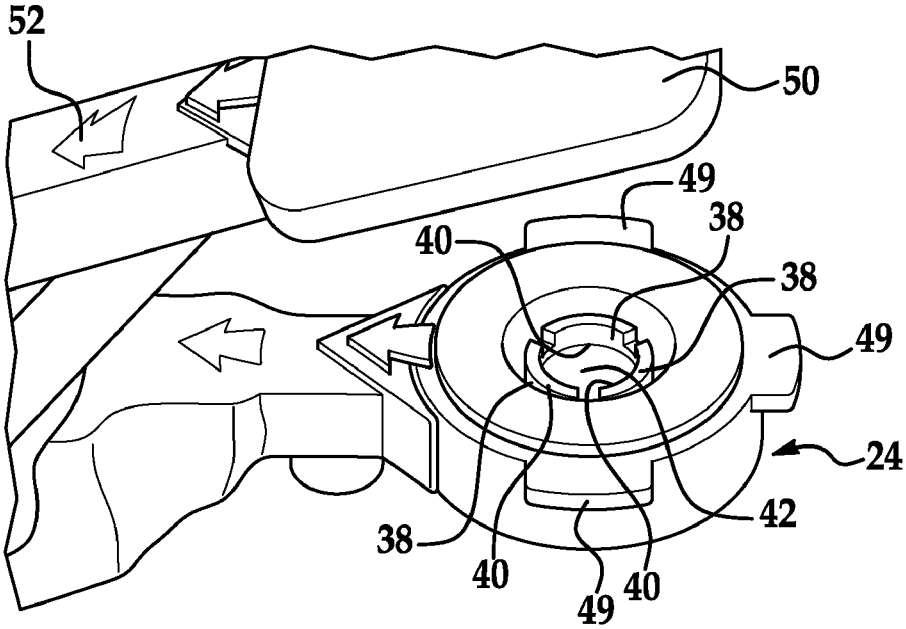
Figure 7:
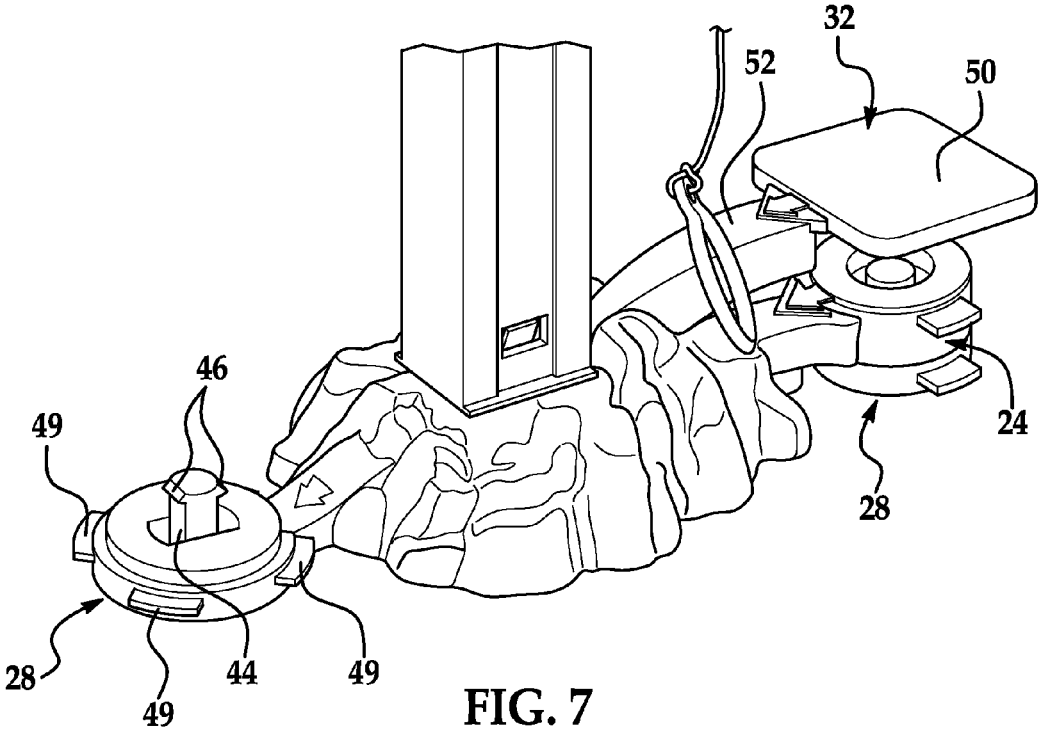
FIGS. 7 and 8 are perspective views of a second coupling member of an interchangeable linking segment in accordance with an exemplary embodiment of the present invention.
Figure 8:
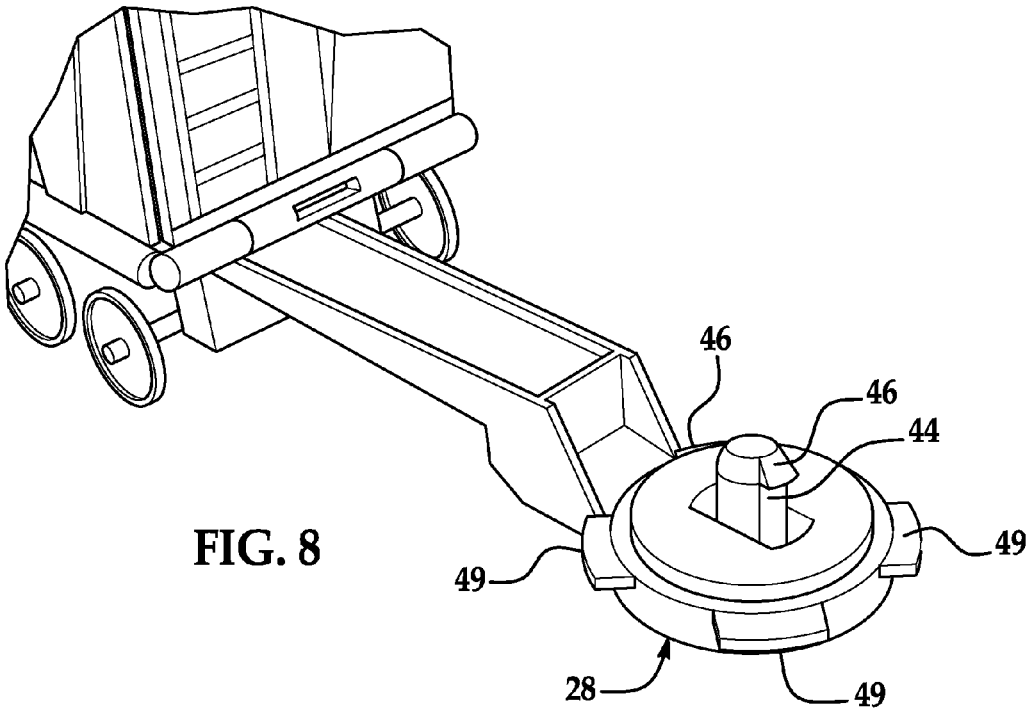
Figure 9:
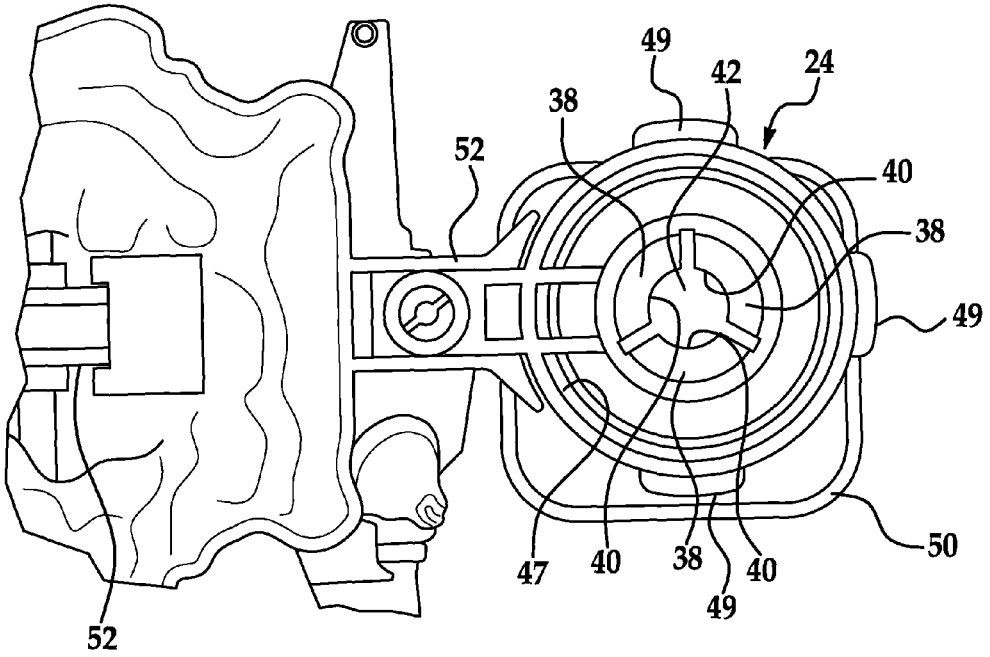
FIG. 9 is a bottom perspective view of a first coupling member and a trigger of an interchangeable linking segment in accordance with an exemplary embodiment of the present invention.

Referring now to at least FIGS. 1-4 a toy set 10 having at least two linking toy segments 12 and 14 is illustrated. FIGS. 1 and 2 illustrate one non-limiting embodiment and FIGS. 3 and 4 illustrate another non-limiting embodiment. Referring in general to at least FIGS. 1-4, each toy segment has a base structure 16 configured to be placed on a surface 15 and an actuatable device 18 that is moveably secured to the base structure. The actuatable device is capable of movement from a first position 20 (FIG. 1) to a second position 22 (FIG. 2) wherein a desired affect is provided as will be discussed below.

Each toy segment 12, 14 has a first coupling member 24 secured to the base structure and extending away from the base structure in a first direction 26. In addition, each toy segment 12, 14 has a second coupling member 28 secured to the base structure and extending away from the base structure in a second direction 30, the first direction being different from the second direction.

In accordance with an exemplary embodiment of the present invention, the first coupling member is configured to be pivotally received on top of another coupling member, namely the second coupling member of another toy segment. As such, the second coupling member is configured to be pivotally secured underneath another coupling member, namely a first coupling member of another toy segment.

In addition, each toy segment has a trigger 32 moveably secured to the base structure proximate to either the first coupling member or the second coupling member. The trigger is pivotally mounted to the base structure for movement between a first position 33 (FIG. 1) and a second position 35 (FIG. 2).

Movement of the trigger from the first position to the second position will cause the actuatable member to move or release the actuatable member from the first position towards the second position.

As illustrated in FIGS. 1-4, a portion 36 of the actuatable device of each one of the plurality of interchangeable linking segments is positioned to contact and move the trigger of another one of the plurality of interchangeable linking segments towards the second position of the trigger when the interchangeable linking segments are coupled together and the portion of the actuatable device contacts and moves the trigger of the another one of the plurality of interchangeable linking segments from the first position to the second position.

Referring now to at least FIGS. 5-9 the first coupling member of each toy segment has a plurality of flexible tabs 38 each having a distal end 40 that defines a portion of a central aperture 42 of the first coupling member. In addition, the second coupling member of each of the toy segments has a shaft portion 44 that extends upwardly from the second coupling member. The shaft portion having at least one feature 46 that causes a periphery of the shaft portion to be greater than an inner periphery of the central aperture thereby securing the shaft portion to the first coupling member when the at least one feature of the shaft portion passes by the distal end of at least one of the plurality of flexible tabs. This arrangement allows the first coupling member to be pivotally received on top of another coupling member, namely the second coupling member of another toy segment as well as the second coupling member being configured to be pivotally secured underneath the first coupling member of another toy segment.

It is, of course, understood that alternative coupling arrangements may be employed and exemplary embodiments of the present invention are not limited to the specific configurations illustrated herein. Accordingly, the central aperture and the plurality of flexible tabs are configured to releasably engage the shaft portion of another coupling member.

In addition, each second coupling member will have a base portion 45 configured to be rotatably received in an aperture 47 of each first coupling member to allow for the rotation or pivotal movement of the coupling members with respect to each other. Furthermore, this coupling arrangement allows the first coupling member to be pivotally secured to the second coupling member such that movement in the direction of arrows 48 is possible between segments coupled together. This movement allows the segments to be arranged in different angular positions while still being coupled together. Moreover and regardless of the angular arrangement of the two segments with respect to each other each segment is configured such that movement of the actuatable device to the second position will cause portion 36 to move the trigger to the second position.

In addition and in one non-limiting embodiment, each coupling member will have a plurality of peripheral tab portions 49 extending from a peripheral portion of the coupling member. As illustrated in the FIGS. the peripheral tab portions of the first coupling member are located towards an upper surface of the first coupling member and the peripheral tab portions of the second coupling member are located towards the bottom of the second coupling member. Accordingly and when the first coupling member is pivotally secured to the second coupling member the positioning of the tabs upper and lower allows a users fingers to grab the tabs and pull the second coupling member from the first coupling member.

In one non-limiting embodiment the trigger has a platform portion 50 and an arm member 52 secured to the platform portion at one end and pivotally secured to the base structure at the other end. In one embodiment, the trigger is spring biased into the first position by a spring 54 positioned in the base portion.

In accordance with various embodiments of the present invention, the actuatable devices may be theme or character related in that each actuatable device is a character or is representative of a story line in a book, movie, play, television show or any other form of media. Furthermore each actuatable device may perform additional actions as it transitions from the first position to the second position. For example and as illustrated in FIGS. 1 and 2, one of the linking segments has a movable arm member 56, which moves downwardly towards a trigger of a linking segment secured thereto. In this embodiment a toy car 58 having a pair of portions 59 releasably secured to each other that are pulled apart by a spring biased mechanism 60 which is triggered by the downward movement of the arm member. Accordingly and as the trigger is depressed the arm member moves from the first or upright position downward towards the trigger of another segment coupled thereto and the mechanism 60 pulls the portions 59 apart giving the appearance that the car has been broken in two by the member. Thus, the actuatable device illustrated here performs two functions one triggering a device of another segment coupled thereto and triggers the mechanism 60. In one embodiment, the arm member 56 of this mechanism is also spring biased into the first position and movement of the trigger will release a catch or any other equivalent means known to those skilled in the related arts to release the spring biased force and cause member 56 to move towards the second position.

Also shown in FIGS. 1 and 2 on the other relay segment is a tower structure 62, wherein the movable portion is an object secured to a cord which has a releasable catch holding the object in the first position and movement of the associated trigger to the second position releases the catch and the object falls downward due to gravity and depresses a trigger of another relay segment coupled thereto. Although FIGS. 1 and 2 only shows two relay segments coupled together it is, of course contemplated that numerous relay segments of different configurations may be secured thereto. As such, the moveable member of each relay segment is configured to actuate a trigger of a relay segment coupled thereto.

FIGS. 3 and 4 illustrate one of numerous other contemplated configurations and embodiments, here relay segment 12 is a portion of a train track and movement of the trigger to the second position moves a linking member 70 coupled thereto move a catch 72 which releases a wheeled object 74 down the track via gravity and the wheeled object moves causes an object 36 to move the trigger of another relay segment coupled thereto. Movement of this relay segment causes panels 76 of a box car to fall open, one of which is the portion 36 that is positioned to move another trigger.

In this embodiment, relay segment 12 has a two part function/sequence, release of an object, which moves from one position to another and then the object causes a portion to move another trigger coupled thereto. Accordingly and in this embodiment, there is a slight time delay between triggering events, which allows the action sequence to be played out.

Exemplary embodiments allow a plurality of toy relay segments to be releasably and pivotally secured other relay segments via coupling members of the relay segments, each being configured to be releasably secured to another coupling member such that the securement of the relay segments together positions the actuatable device to move a trigger of another relay segment coupled thereto.

Thus the various embodiments provide for customizable toy sets wherein a plurality of interchangeable relay segments, each of which may be releasably and pivotally coupled to each other, allow a user to create a customized expandable set. The relay segments may include one or more stunt elements and may be selectively positioned at the beginning, middle, or end of the track set. Each relay segment may be configured to enable a toy vehicle or object to traverse an obstacle and/or perform a stunt and launch the toy vehicle down a track towards another relay segment, which then may initiate a second vehicle or object to be released and traverse still another obstacle and/or perform still another stunt.

A user may customize the track by positioning the relay segments in desired portions of the track. In one embodiment, a plurality of relay segments may be sequentially coupled together with a plurality of track segments to generate a series of relay events. The series of events, which may include various stunt elements, can be rearranged in a plurality of sequences and/or parallel paths to provide numerous play patterns. In this way, a user can experience diverse track play and excitement time and time again.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A toy linking segment for pivotal securement to another toy linking segment, the toy linking segment comprising:

a base structure configured to rest upon a surface;

an actuatable device secured to the base structure, the actuatable device being capable of movement from a first position to a second position;

a first coupling member secured to the base structure and extending away from the base structure in a first direction along the surface, the first coupling member being configured to be pivotally received on top of another coupling member;

a second coupling member secured to the base structure and extending away from the base structure in a second direction along the surface, the first direction being different from the second direction, the second coupling member being configured to rest upon the surface and be pivotally secured underneath another coupling member;

a trigger operably coupled to the actuatable device and moveably secured to the base structure proximate to either the first coupling member or the second coupling member, the trigger being pivotally mounted to the base for movement between a first position and a second position; and wherein the actuatable device is moved from the first position to the second position when the trigger is moved from the first position to the second position.

2. The toy linking segment as in claim 1, wherein the first coupling member has a plurality of flexible tabs each having a distal end that defines a portion of a central aperture of the first coupling member.

3. The toy linking segment as in claim 1, wherein the first coupling member has a plurality of flexible tabs each having a distal end that defines a portion of a central aperture of the first coupling member, the central aperture and the plurality of flexible tabs are configured to releasably engage a shaft portion of another coupling member.

4. The toy linking segment as in claim 3, wherein the shaft portion of another coupling member has at least one feature that causes a periphery of the shaft portion to be greater than an inner periphery of the central aperture thereby securing the shaft portion to the first coupling member when the at least one feature passes by the distal end of at least one of the plurality of flexible tabs.

5. The toy linking segment as in claim 1, wherein trigger is spring biased into the first position.

6. The toy linking segment as in claim 1, wherein trigger further comprises a platform portion and an arm member secured to the platform portion at one end and pivotally secured to the base structure at the other end.

7. The toy linking segment as in claim 6, wherein the platform portion and the arm member are spring biased into the first position.

8. A toy set, comprising:

a plurality of interchangeable linking segments each being configured for pivotal securement to each other, each linking segment having:

a base structure configured to rest upon a surface;

an actuatable device secured to the base structure, the actuatable device being capable of movement from a first position to a second position;

a first coupling member secured to the base structure and extending away from the base structure in a first direction along the surface, the first coupling member being configured to be pivotally received on top of another coupling member;

a second coupling member secured to the base structure and extending away from the base structure in a second direction along the surface, the first direction being different from the second direction, the second coupling member being configured to rest upon the surface and be pivotally secured underneath another coupling member of another one of the plurality of interchangeable linking segments;

a trigger operably coupled to the actuatable device and moveably secured to the base structure proximate to either the first coupling member or the second coupling member, the trigger being pivotally mounted to the base movement between a first position and a second position; and wherein the actuatable device is moved from the first position to the second position when the trigger is moved from the first position to the second position.

9. The toy set as in claim 8, wherein a portion of the actuatable device of one of the plurality of interchangeable linking segments contacts and moves the trigger of another one of the plurality of interchangeable linking segments when they are coupled together and the portion of the actuatable device contacts and moves the trigger of the another one of the plurality of interchangeable linking segments from the first position to the second position.

10. The toy set as in claim 9, wherein trigger is spring biased into the first position and the trigger further comprises a platform portion and an arm member secured to the platform portion at one end and pivotally secured to the base structure at the other end.

11. The toy set as in claim 8, wherein the first coupling member has a plurality of flexible tabs each having a distal end that defines a portion of a central aperture of the first coupling member.

12. The toy set as in claim 8, wherein the first coupling member has a plurality of flexible tabs each having a distal end that defines a portion of a central aperture of the first coupling member, the central aperture and the plurality of flexible tabs are configured to releasably engage a shaft portion of another coupling member.

13. The toy set as in claim 12, wherein the shaft portion of another coupling member has at least one feature that causes a periphery of the shaft portion to be greater than an inner periphery of the central aperture thereby securing the shaft portion to the first coupling member when the at least one feature passes by the distal end of at least one of the plurality of flexible tabs.

14. The toy set as in claim 8, wherein trigger is spring biased into the first position.

15. The toy set as in claim 8, wherein trigger further comprises a platform portion and an arm member secured to the platform portion at one end and pivotally secured to the base structure at the other end.

16. The toy set as in claim 15, wherein platform portion and the arm member are spring biased into the first position.

17. A method for pivotally coupling a plurality of toy relay segments together, the method comprising:

pivotally securing either a first coupling member or a second coupling member of a first one of the plurality of interchangeable linking segments to either a first coupling member or a second coupling member of a second one of the plurality of interchangeable linking segments;

wherein the first coupling member of the first one of the plurality of interchangeable linking segments is secured to a base structure configured to rest upon a surface and extends away from the base structure in a first direction along the surface and is configured to be pivotally received on top of the second coupling member of the second one of the plurality of interchangeable linking segments;

wherein the second coupling member of the first one of the plurality of interchangeable linking segments is secured to the base structure and extends away from the base structure along the surface in a second direction and is configured to rest upon the surface and be pivotally received beneath the first coupling member of the second one of the plurality of interchangeable linking segments, the second direction being different from the first direction; and wherein an actuatable device is secured to each of the first one of the plurality of interchangeable linking segments and the second one of the plurality of interchangeable linking segments, each actuatable device being capable of movement from a first position to a second position and a trigger is moveably secured to each of the first one of the plurality of interchangeable linking segments and the second one of the plurality of interchangeable linking segments, each trigger being operably coupled to one of the actuatable devices and each trigger is pivotally mounted for movement between a first position and a second position; and wherein the actuatable device of each of the plurality of interchangeable linking segments is moved from the first position to the second position when the trigger of the corresponding one of the plurality of interchangeable linking segments is moved from the first position to the second position.

18. The method in claim 17, wherein a portion of the actuatable device of one of the plurality of interchangeable linking segments contacts and moves the trigger of another one of the plurality of interchangeable linking segments when they are coupled together and the portion of the actuatable device contacts and moves the trigger of the another one of the plurality of interchangeable linking segments from the first position to the second position.

19. The method as in claim 18, wherein trigger is spring biased into the first position and the trigger further comprises a platform portion and an arm member secured to the platform portion at one end and pivotally secured to the base structure at the other end.

20. The method as in claim 17, wherein the first coupling member has a plurality of flexible tabs each having a distal end that defines a portion of a central aperture of the first coupling member, the central aperture and the plurality of flexible tabs are configured to releasably engage a shaft portion of another coupling member and wherein the shaft portion of another coupling member has at least one feature that causes a periphery of the shaft portion to be greater than an inner periphery of the central aperture thereby securing the shaft portion to the first coupling member when the at least one feature passes by the distal end of at least one of the plurality of flexible tabs.

* * * * *